US009051821B2

(12) United States Patent
Tan et al.

(10) Patent No.: US 9,051,821 B2
(45) Date of Patent: Jun. 9, 2015

(54) MICROFLUIDIC METHODS AND APPARATUS TO PERFORM IN SITU CHEMICAL DETECTION

(75) Inventors: Wei Heong Tan, Sagamihara (JP); Christopher Harrison, Auburndale, MA (US); Tsutomu Yamate, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 936 days.

(21) Appl. No.: 12/334,522

(22) Filed: Dec. 15, 2008

(65) Prior Publication Data

US 2010/0147065 A1 Jun. 17, 2010

(51) Int. Cl.

| | |
|---|---|
| ***E21B 49/10*** | (2006.01) |
| ***E21B 47/10*** | (2012.01) |
| ***E21B 49/08*** | (2006.01) |
| *B01L 3/00* | (2006.01) |

(52) U.S. Cl.

CPC ..... *E21B 47/10* (2013.01); *B01L 3/502707* (2013.01); *B01L 3/502715* (2013.01); *B01L 3/502738* (2013.01); *E21B 49/081* (2013.01)

(58) Field of Classification Search

None

See application file for complete search history.

(56) References Cited

U.S. PATENT DOCUMENTS

| | | | | |
|---|---|---|---|---|
| 2003/0134426 | A1* | 7/2003 | Jiang et al. | 436/121 |
| 2004/0045350 | A1* | 3/2004 | Jones et al. | 73/152.23 |
| 2004/0129874 | A1 | 7/2004 | Torgersen et al. | |
| 2004/0202579 | A1 | 10/2004 | Larsson et al. | |
| 2006/0005965 | A1* | 1/2006 | Chouzenoux et al. | 166/250.11 |
| 2006/0008382 | A1* | 1/2006 | Salamitou et al. | 422/57 |
| 2006/0165565 | A1* | 7/2006 | Ermakov | 422/130 |
| 2006/0234298 | A1* | 10/2006 | Chiu et al. | 435/7.1 |
| 2007/0028969 | A1* | 2/2007 | Bovd et al. | 137/606 |
| 2007/0061093 | A1* | 3/2007 | Angelescu et al. | 702/100 |
| 2008/0066908 | A1* | 3/2008 | Oddie | 166/264 |
| 2009/0078036 | A1* | 3/2009 | Terabayashi et al. | 73/152.55 |
| 2009/0130766 | A1* | 5/2009 | Weekamp | 436/63 |
| 2010/0136544 | A1* | 6/2010 | Agresti et al. | 435/6 |

FOREIGN PATENT DOCUMENTS

| | | | | |
|---|---|---|---|---|
| WO | WO2008109176 | * | 9/2008 | C12Q 1/68 |

OTHER PUBLICATIONS

Wei-Heong Tan and Shoji Takeuchi, "Timing Controllable Electrofusion Device for Aqueous droplet-based microreactors," The Journal of the Royal Society of Chemistry, Lab Chip, 2006, vol. 6, pp. 757-763.

Hong Chen, Qun Fang, Xue-Feng Yin, Zhao-Lun Fang, "Microfluidic chip-based liquid-liquid extraction and preconcentration using a subnanoliter-droplet trapping technique," The Journal of the Royal Society of Chemistry, Lab Chip, 2005, vol. 5, pp. 719-725.

* cited by examiner

*Primary Examiner* — Jill Warden

*Assistant Examiner* — Timothy G Kingan

(74) *Attorney, Agent, or Firm* — Daryl R. Wright; Jody DeStefanis

(57) ABSTRACT

Example microfluidic methods and apparatus to perform in situ chemical detection are disclosed. A disclosed example downhole apparatus comprises a microfluidic chamber to introduce a microfluidic-scale drop of a reagent into a formation fluid to form a mixed fluid, a flowline to fluidly couple the formation fluid from a geologic formation to the microfluidic chamber, and a detector to measure a property of the mixed fluid, the property representative of a presence of a chemical in the formation fluid.

7 Claims, 6 Drawing Sheets

MICROFLUIDIC METHODS AND APPARATUS TO PERFORM IN SITU CHEMICAL DETECTION

FIELD OF THE DISCLOSURE

This disclosure relates generally to chemical detection and, more particularly, to microfluidic methods and apparatus to perform in situ chemical detection.

BACKGROUND

Wellbores are drilled to, for example, locate and produce hydrocarbons. During a drilling operation, it may be desirable to perform evaluations of the formations penetrated by the wellbore. In some cases, a drilling tool is removed and a wireline tool is then deployed into the wellbore to test and/or sample the formation and/or fluids associated with the formation. In other cases, the drilling tool may be provided with devices to test and/or sample the surrounding formation and/or formation fluids without the need to remove the drilling tool from the wellbore. These samples or tests may be used, for example, to characterize hydrocarbons and/or detect the presence of chemicals, such as carbon dioxide or hydrogen sulfide, in formation fluids.

Formation evaluation often requires that fluid(s) from the formation be drawn into the downhole tool for testing, evaluation and/or sampling. Various devices, such as probes, are extended from the downhole tool to establish fluid communication with the formation surrounding the wellbore and to draw fluid(s) into the downhole tool. Fluid(s) passing through the downhole tool may be tested and/or analyzed to determine various downhole parameters and/or properties while the downhole tool is positioned in situ. Various properties of hydrocarbon reservoir fluids, such as viscosity, density and phase behavior of the fluid at reservoir conditions, and/or a presence and/or absence of chemicals, may be used to evaluate potential reserves, determine flow in porous media and design completion, separation, treating, and metering systems, among others.

Additionally, samples of the fluid(s) may be collected in the downhole tool and retrieved at the surface. The downhole tool stores the formation fluid(s) in one or more sample chambers or bottles, and retrieves the bottles to the surface while, for example, keeping the formation fluid pressurized. These fluids may then be sent to an appropriate laboratory for further analysis, for example. Typical fluid analysis or characterization may include, for example, composition analysis, fluid properties and phase behavior, and/or a presence and/or absence of chemicals. Additionally or alternatively, such analysis may be made at the wellsite using a transportable lab system.

SUMMARY

Example microfluidic methods and apparatus to perform in situ chemical detection are disclosed. A disclosed example downhole apparatus includes a microfluidic chamber to introduce a microfluidic-scale drop of a reagent into a formation fluid to form a mixed fluid, a flowline to fluidly couple the formation fluid from a geologic formation to the microfluidic chamber, and a detector to measure a property of the mixed fluid, the property representative of a presence of a chemical in the formation fluid.

Another disclosed example downhole apparatus includes a channel having first and second ends, wherein the second end is opposite the first end, a microchamber situated between the first and second ends of the channel, a reagent reservoir to fluidly couple a reagent into the channel at the first end of the channel, wherein the microchamber is to trap a portion of the reagent in the microchamber when the reagent flows from the first end to the second end of the channel, a flowline to fluidly couple a formation fluid from a geologic formation into the channel at the first end of the channel, wherein the formation fluid reacts with the trapped portion of the reagent to form a reaction product in the microchamber when the formation fluid flows form the first end to the second end of the channel, and a detector situated at the microchamber to measure a property of the reaction product, the property representative of a presence of a chemical in the formation fluid.

A disclosed example method to perform detection of a chemical within a wellbore includes flowing a reagent through a channel to trap a portion of the reagent in a microchamber associated with the channel, flowing a formation fluid from a geologic formation through the channel to form a reaction product of the trapped portion of the reagent and the formation fluid within the microchamber, and measuring a property of the reaction product, the property representative of a presence of the chemical in the formation fluid.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness. Moreover, while certain preferred embodiments are disclosed herein, other embodiments may be utilized and structural changes may be made without departing from the scope of the invention.

DETAILED DESCRIPTION

The example microfluidic methods and apparatus disclosed herein provide certain advantages for downhole and/or wellbore applications that include, but are not limited to, a reduction in the volume of reagent that must be stored and/or used within a downhole tool, an increase in reaction rates resulting from the increased surface area upon which reagent and formation fluids react, and an improved diffusion of a reagent within a formation fluid. Additionally, the examples described herein do not utilize and/or require the use of a membrane, which can become clogged and, thus, result in an inability to continue performing in situ chemical detection and/or require the withdrawal of a downhole tool for repair and/or maintenance. As such, in situ chemical detection within downhole tools and/or wellbores can be made more accurate, more feasible and/or enabled to operate for longer periods of time by application of the example methods and apparatus disclosed herein.

The term "microfluidic" as used herein is to be understood, without any restriction thereto, to refer to structures or devices through which a fluid is capable of being passed or directed, wherein one or more of the dimensions and/or features sizes of the structure and/or device is less than about 500 microns (millionths of a meter). Moreover, the term "microfluidic-scale" is used herein to convey a dimension and/or feature size that consistent with microfluidic devices and/or structures.

The terms "channel" and "chamber" as used herein are to be interpreted in their broadest sense. These terms are not restricted to elongated configurations where the transverse or longitudinal dimension exceeds the diameter or cross-sectional dimension. Rather, such terms are meant to comprise cavities or tunnels of any desired shape and/or configuration through which fluids may be directed. A microfluidic channel and/or chamber has a smallest dimension that is at least about 1 micron but is less than about 500 microns.

Figure 1:
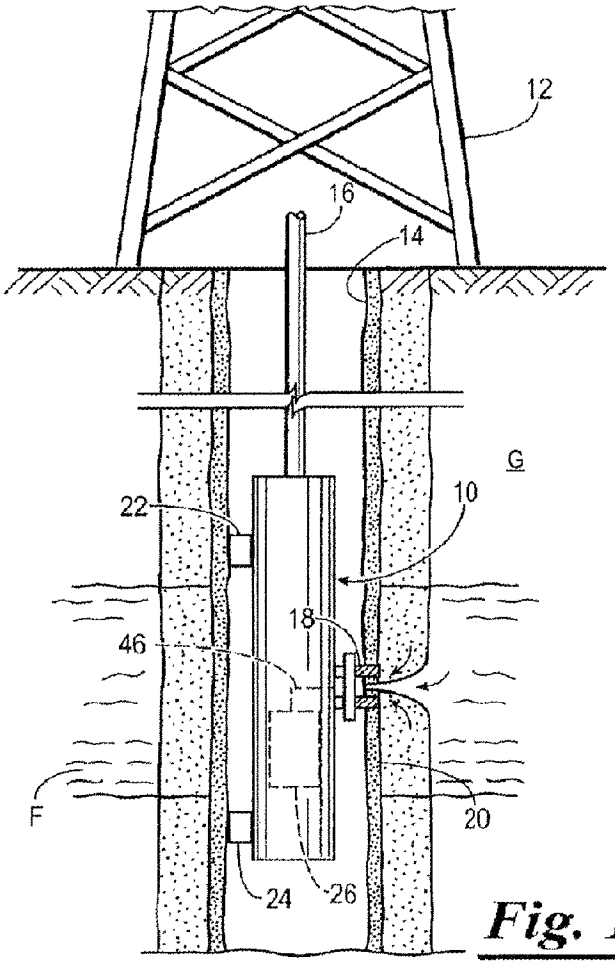
FIG. 1 is a schematic, partial cross-sectional view of a downhole wireline tool suspended from a rig and having an internal chemical detection assembly with the wireline tool.

FIG. 1 shows a schematic, partial cross-sectional view of an example downhole tool 10. The example downhole tool 10 of FIG. 1 is suspended from a rig 12 into a wellbore 14 formed in a geologic formation G. The example downhole tool 10 can implement any type of downhole tool capable of performing formation evaluation, such as chemical detection, fluid analysis, fluid sampling, well logging, etc. The example downhole tool 10 of FIG. 1 is a wireline tool deployed from the rig 12 into the wellbore 14 via a wireline cable 16 and positioned adjacent to a formation F.

To seal the example downhole tool 10 of FIG. 1 to a wall 20 of the wellbore 14 (hereinafter referred to as a "wall 20" or "wellbore wall 20"), the example downhole tool 10 includes a probe 18. The example probe 18 of FIG. 1 forms a seal against the wall 20 and draws fluid(s) from the formation F into the downhole tool 10 as depicted by the arrows. Backup pistons 22 and 24 assist in pushing the example probe 18 of the downhole tool 10 against the wellbore wall 20.

To perform chemical detection, the example downhole tool 10 of FIG. 1 includes a chemical detection assembly 26 constructed in accordance with this disclosure. The example chemical detection assembly 26 of FIG. 1 performs in situ chemical detection for downhole fluids, such as the formation fluids extracted or drawn from the formation F. The example chemical detection assembly 26 receives the formation fluid(s) from the probe 18 via an evaluation flowline 46. Example manners of implementing the example chemical detection assembly 26 of FIG. 1 are described below in connection with FIGS. 3 and 4.

Figure 2:
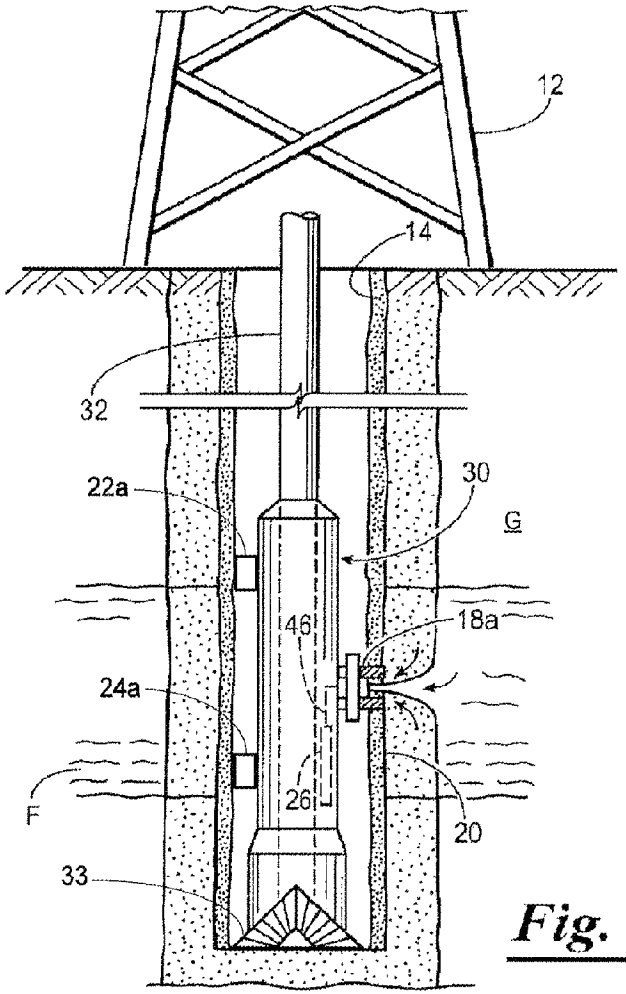
FIG. 2 is a schematic, partial cross-sectional view of a downhole drilling tool suspended from a rig and having an internal chemical detection assembly with the downhole drilling tool.

FIG. 2 shows a schematic, partial cross-sectional view of another example of a downhole tool 30. The example downhole tool 30 of FIG. 2 can be conveyed among one or more (or itself may be) of a measurement-while-drilling (MWD) tool, a logging-while-drilling (LWD) tool, or other type of downhole tool that are known to those skilled in the art. The example downhole tool 30 is attached to a drill string 32 and a drill bit 33 driven by the rig 12 to form the wellbore 14 in the geologic formation G.

To seal the example downhole tool 30 of FIG. 2 to the wall 20 of the wellbore 14, the downhole tool 30 includes a probe 18*a*. The example probe 18*a* of FIG. 2 forms a seal against the wall 20 and draws fluid(s) from the formation F into the downhole tool 30 as depicted by the arrows. Backup pistons 22*a* and 24*a* assist in pushing the example probe 18*a* of the downhole tool 30 against the wellbore wall 20. Drilling is stopped before the probe 18*a* is brought in contact with the wall 20.

To perform chemical detection, the example downhole tool 30 of FIG. 2 also includes the example chemical detection assembly 26. The example chemical detection assembly 26 of FIG. 2 performs in situ chemical detection and/or analysis of downhole fluids, such as the formation fluids extracted or drawn from the formation F. The example chemical detection assembly 26 receives the formation fluid(s) from the probe 18*a* via the evaluation flowline 46. Example manners of implementing the example chemical detection assembly 26 of FIG. 2 are described below in connection with FIGS. 3 and 4.

While FIGS. 1 and 2 depict the chemical detection assembly 26 in the example downhole tools 10 and 30, the chemical detection assembly 26 may instead be provided or implemented at the wellsite (e.g., at the surface near the wellbore 14), and/or an offsite facility for performing fluid tests. By positioning the chemical detection assembly 26 in the downhole tool 10, 30, real-time data may be collected concerning chemicals present in downhole fluids. However, it may also be desirable and/or necessary to test fluids at the surface and/or offsite locations. In such cases, the chemical detection assembly 26 may be positioned in a housing transportable to a desired location. Alternatively, fluid samples may be taken to a surface or offsite location and tested in the chemical detection assembly 26 at such a location. Data and test results from various locations may be analyzed and compared.

Figure 3:
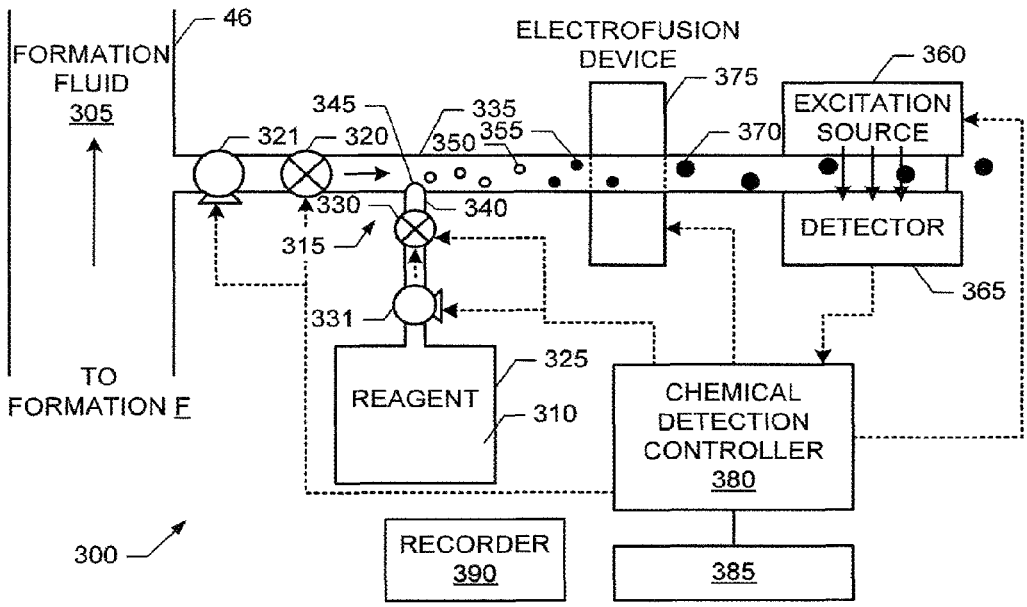
FIGS. 3, 3A and 4 illustrate example manners of implementing the example chemical detection assemblies of FIGS. 1 and 2.

FIG. 3 is a schematic diagram of an example chemical detection assembly 300. The example chemical detection assembly 300 of FIG. 3 may be used to implement the example chemical detection assembly 26 of FIGS. 1 and 2, and/or may be used to perform chemical detection at the surface, at a wellsite, in a transportable lab, and/or in a fixed-location facility.

To infuse a formation fluid 305 with droplets of a reagent 310, the example chemical detection assembly 300 of FIG. 3 includes a microfluidic chamber 315. The formation fluid 305 is fluidly coupled to the example microfluidic chamber 315 of FIG. 3 via the example evaluation flowline 46. To control whether the formation fluid 305 flows into the example microfluidic chamber 315, the example chemical detection assembly 300 of FIG. 3 includes any type of valve 320. The example valve 320 of FIG. 3 can be selectively configured to adjust and/or control at what rate the formation fluid 305 flows into and, thus, through the microfluidic chamber 315.

To store the example reagent 310, the example chemical detection assembly 300 of FIG. 3 includes any number and/or type(s) of containers, reservoirs and/or bottles, one of which is designated at reference numeral 325. To control whether and/or when the reagent 310 flows into the microfluidic chamber 315, the example chemical detection assembly 300 includes any type of valve 330. The example valve 330 of FIG. 3 can be selectively configured to adjust and/or control at what rate the reagent 310 flows into and, thus, through the microfluidic chamber 315.

The example microfluidic chamber 315 of FIG. 3 is implemented as a micro T-junction chamber, wherein the formation fluid 305 flows through a main channel 335 of the chamber 315 and the reagent 310 flows through a tributary channel 340. The example tributary channel 340 of FIG. 3 is fluidly coupled to the example main channel 335 at a port 345 of the main channel 335. The example port 345 of FIG. 3 has a cross-section (e.g., a square cross-section) that corresponds to the cross-section of the example tributary channel 340. In some examples, the tributary channel 340 has cross-sectional dimensions of 100 microns by 100 microns, and/or has a feature size that is less than 200 microns. Other tributary channel dimensions may be used. However, in general, a smaller tributary channel 340 requires a more energetic flow of the reagent 310 through the tributary channel 340. In the illustrated example of FIG. 3, the formation fluid 305 flows from left to right past the example port 345. As the formation fluid 305 flows past the port 345, microfluidic-scale droplets of the reagent 310 (one of which is designated at reference numeral 350) are "pinched off" from the tributary channel 340 and an emulsification, a mixture and/or a mixed fluid comprising the formation fluid 305 and the micro-fluidic reagent droplets 350 is formed. In some examples, the micro-fluidic reagent droplets 350 have feature sizes that are less than 200 microns.

While a single tributary channel 340 and a single reagent 310 are shown in FIG. 3, the example chemical detection assembly 300 of FIG. 3 could include multiple tributary channels 340 associated with different types of reagents 310. As such, the example chemical detection assembly 300 could be used to detect the presence of different types of chemicals using different types of reagents 310.

To form an energetic flow of the formation fluid 305 and the reagent 310, the example chemical detection assembly 300 of FIG. 3 includes any type(s) of pumps 321 and 331, respectively. The example pump 321 of FIG. 3 may be activated to drive the formation fluid 305 through the channel 335. The example pump 331 of FIG. 3 may be activated to drive the reagent 310 through the channel 340. While the example pump 321 of FIG. 3 is shown at the left end of the channel 335, the pump 321 could be located elsewhere along the channel 335. For example, the pump 321 could be located to the right end of the detector 365.

The chemicals present in the formation fluid 305 (not shown) and the reagent droplets 350 chemically react to form reaction products, one of which is designated at reference numeral 355. In general, the type of chemical to be detected determines the type of the reagent 310 that is used, and the type(s) of reaction products 355 formed depends on the type of chemical(s) present and the type of reagent 310 that is used. Chemicals that may be detected by the example chemical detection assembly 300 of FIG. 3 include, but are not limited to, hydrogen sulfide and/or carbon dioxide. Example reagents 310 for the detection of hydrogen sulfide include, but are not limited to, fluorescein mercuric acetate (FMA) and/or Phenol red. Example reagents 310 for the detection of carbon dioxide include, but are not limited to, limewater (i.e., a saturated calcium hydroxide solution) and/or Phenol red.

To detect the reaction products 355, the example chemical detection assembly 300 of FIG. 3 includes an excitation source 360 and one or more detectors, one of which is designated at reference numeral 365. The example excitation source 360 of FIG. 3 excites the reaction products 355 with, for example, a light source, which causes the reaction products 355 to radiate and/or give off light (i.e., to fluoresce) and/or to absorb energy and/or light. The amount of fluorescence and/or absorption by the reaction products 355 can be measured by the example detector 365 of FIG. 3 and used to detect the presence of chemicals in the formation fluid 305. The type of energy and/or light used to excite the reaction products 355 and the type of the detector 365 used depends on the type of chemical(s) being detected and/or the type of reagent(s) 310 being used. Example detectors 365 include, but are not limited to, an optical detector and/or a photodiode. Additionally or alternatively, a conductivity and/or resistivity detector may be used to measure a change in conductivity and/or resistivity of the formation fluid 305 caused by the presence and/or absence of the reaction particles 355.

To fuse the reaction products 355 together to form larger reaction products, one of which is designated at reference numeral 370, the example chemical detection assembly 300 of FIG. 3 includes any type of electrofusion device 375. By applying an electric field, aqueous (i.e., water) based reaction products 355 can be fused, bonded and/or electrically joined together. For fluidic droplets, such electrofusion represents droplet coalescence. In some examples, the creation of larger reaction products 370 improves and/or facilitates a detection process implemented by the example excitation source 360 and the detector 365. An example electrofusion device 375 is described in "Timing Controllable Electrofusion Device for Aqueous droplet-based microreactors," by Wei-Heong Tan and Shoji Takeuchi, published in The Journal of the Royal Society of Chemistry, Lab Chip, 2006, vol. 6, pages 757-763, and which is hereby incorporated by reference in its entirety.

To control the chemical detection assembly 300, the example chemical detection assembly 300 of FIG. 3 includes a chemical detection controller 380. The example chemical detection controller 380 of FIG. 3(*a*) controls the valves 320 and 330 and/or the pumps 321 and 331 to initiate the emulsification and/or mixing of the formation fluid 305 and the reagent 310, (*b*) controls the electrofusion device 375 to fuse and/or join together reaction products 355 to form larger products 370, and (*c*) controls the excitation source 360 and the detector 365 to measure one or more properties of the reaction products 355 and 370. The example controller 380 stores the measured properties in any type and/or number of memory(-ies) and/or memory device(s), one of which is designated at reference numeral 3 85, for later retrieval. Additionally or alternatively, the measured properties can be sent to a surface computer (not shown) using telemetry, and/or be analyzed by the example chemical detection controller 380 to determine whether a chemical is present in the formation fluid 305. The example chemical detection controller 380 may be implemented by hardware, software, firmware and/or any combination of hardware, software and/or firmware. Thus, for example, the example chemical detection controller 380 may be implemented by one or more circuit(s), programmable processor(s), application specific integrated circuit(s) (ASIC(s)), programmable logic device(s) (PLD(s)) and/or field-programmable PLD(s) (FPLD(s)), etc.

To operation information and/or data, the example chemical detection assembly 300 of FIG. 3 includes any number and/or type(s) of recorders, one of which is designated at reference numeral 390. The example recorder 390 of FIG. 3 records, for example, operation time durations, number of valve activations, and/or temperature. Such information may be used to, for example, for maintenance purposes, and/or to perform failure and reliability analyses. Information, data, parameters and/or any other values recorded by the example recorder 390 may be, for example, stored in the memory and/or memory device 385.

Figure 3A:
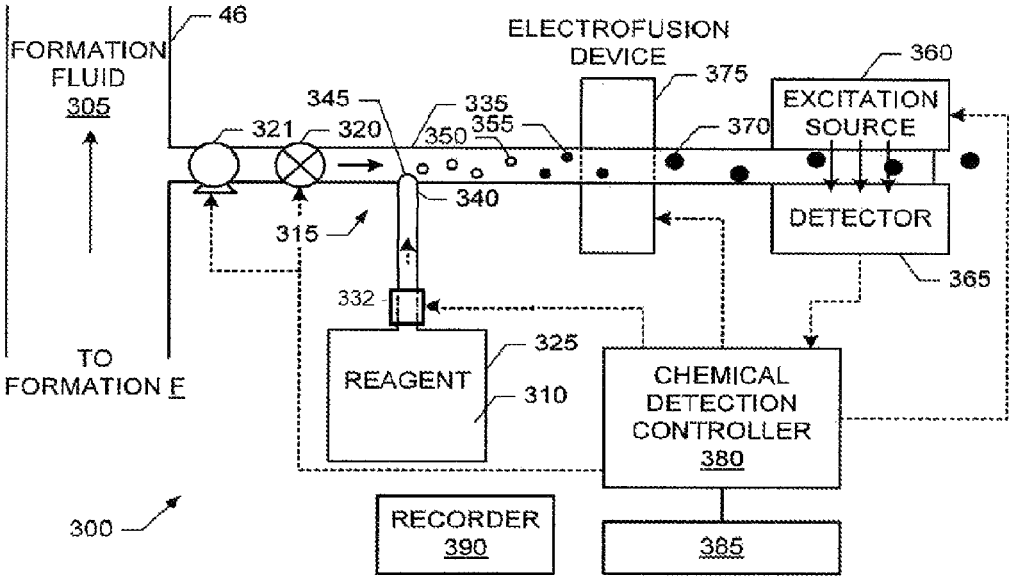

While an example manner of implementing the example chemical detection assembly 26 of FIGS. 1 and 2 has been illustrated in FIG. 3, one or more of the example interfaces, channels 335, 340, chambers 315, containers 325, valves 320 and 330, pumps 321 and 331, detectors 365, excitation sources 360, electrofusion devices 375, recorder 390, flowlines 46, elements and/or devices illustrated in FIG. 3 may be combined, divided, re-arranged, omitted, eliminated and/or implemented in any other way. For example, the pumps 321 and 331 may be omitted. Further, a chemical detection assembly may include interfaces, channels, chambers, containers, valves, detectors, excitation sources, electrofusion devices, flowlines, elements and/or devices instead of, or in addition to, those illustrated in FIG. 3 and/or may include more than one of any or all of the illustrated interfaces, data structures, elements, processes and/or devices. For example, the valve 330 and the pump 331 of FIG. 3 could be removed and a heater 332 (as shown in FIG. 3A) used to heat at least a portion of the reagent container 325 to induce at least a partial phase change, such as from a liquid to a gas state, in the reagent 310. If the heater 332 were to, for example, heat an end of the container 325 opposite the channel 340, such a phase change could be used to force, drive and/or otherwise cause reagent 310 that remains in a liquid state to flow through the channel 340 into the main channel 335. Thus, by controlling the heater 332 a flow of the reagent 340 through the channel 340 could be controlled. Additionally or alternatively, the same or a different heater may be used to reduce the viscosity of the formation fluid 305 and/or the reagent 310 to reduce the amount of energy required to pump them through the channels 335 and 340.

While not shown in FIG. 3 for ease of illustration, the example chemical detection assembly 300 of FIG. 3 may include one or more additional containers and/or reservoirs to store one or more additional chemicals and/or liquids. Such additional chemicals and/or liquids may be used to, for example, flush and/or rinse the channel 335 and/or the channel 340, and/or to clean the detector 365. For example, the channel 335 could be flushed and/or rinsed with ethanol, acetone, etc. If the reagent 310 would react with a chemical and/or liquid used the rinse and/or flush the channel 335 and/or the channel 340, the channel 335 and/or the channel 340 could be subsequently rinsed and/or flushed with water prior to introduction of the reagent 310.

Figure 4:
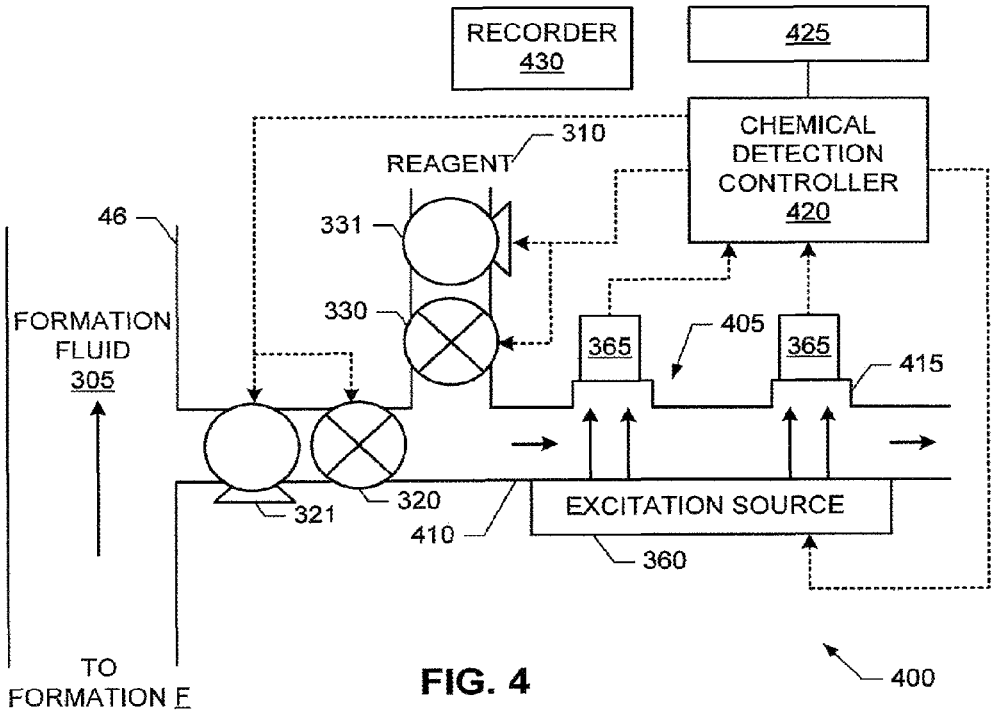

FIG. 4 is a schematic diagram of another example chemical detection assembly 400. The example chemical detection assembly 400 of FIG. 4 may be used to implement the example fluid chemical detection assembly 26 of FIGS. 1 and 2, and/or may be used to perform chemical detection at the surface, at a wellsite, in a transportable lab, and/or in a fixed-location facility.

To infuse the formation fluid 305 with droplets of the reagent 310, the example chemical detection assembly 400 of FIG. 4 includes a microfluidic chamber 405. The formation fluid 305 is fluidly coupled to the example microfluidic chamber 405 of FIG. 4 via the example evaluation flowline 46. To control whether the formation fluid 305 flows into the example microfluidic chamber 405, the example chemical detection assembly 400 of FIG. 4 includes the example valve 320. The example valve 320 and the example pump 321 of FIG. 4 can be selectively configured to adjust and/or control at what rate the formation fluid 305 flows into and, thus, through the example microfluidic chamber 405. While the example pump 321 of FIG. 4 is shown at the left end of the microfluidic chamber 405, the pump 321 could be located elsewhere along the microfluidic chamber 405. For example, the pump 321 could be located at the right end of the detectors 365.

To store the example reagent 310, the example chemical detection assembly 400 of FIG. 4 includes any number and/or type(s) of containers, reservoirs and/or bottles (not shown). To control whether and/or when the reagent 310 flows into the microfluidic chamber 405, the example chemical detection assembly 400 includes the example valve 330. The example valve 330 and the example pump 331 of FIG. 4 can be selectively configured to adjust and/or control at what rate the reagent 310 flows into and, thus, through the example microfluidic chamber 405.

Figure 8A:
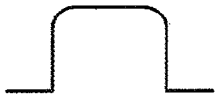
FIGS. 8A-D illustrate additional microchamber cross-sections.
Figure 8B:
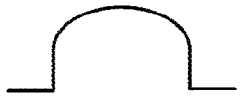
Figure 8C:
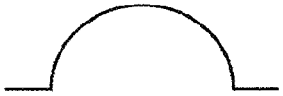
Figure 8D:
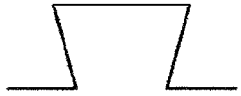

The example microfluidic chamber 405 of FIG. 4 is implemented as a main channel 410 and one or more microfluidic-scale chambers (i.e., microchambers), one of which is designated at reference numeral 415. While, the example microchambers 415 of FIG. 4 are rectangular recesses and/or chambers that are fluidly coupled to the main channel 410, other microchambers 415 having other cross-sections may be, additionally or alternatively, used. Additional and/or alternative example microchamber cross-sections are shown in FIGS. 8A-D. The example microchamber cross-section of FIG. 8A is similar to that illustrated in FIG. 4 except that one or more corners have been rounded and/or chamfered. The example microchamber cross-section of FIG. 8B is rectangular with a rounded top. The example microchamber of FIG. 8C has a spherical and/or rounded cross-section, and the example microchamber of FIG. 8D has a trapezoidal cross-section. Other example microchambers not shown in FIG. 4 and/or FIGS. 8A-D include, but are not limited to cylindrically and/or conically shaped microchambers. The chamber 405 of FIG. 4 may be formed by, for example, a) etching the main channel 410 into a plate of glass, and b) etching the microchambers 415 of FIG. 4 and/or the microchambers of FIGS. 8A-D as holes within the main channel 410.

Returning to FIG. 4, the example microchambers 415 may be implemented on the top, sides and/or bottom of the main channel 410. While, the example microchambers 415 of FIG. 4 have dimensions of 100 microns wide, 100 microns long and 100 microns deep, microchamber 415 having any other dimension(s) and/or feature size(s) may be, additionally or alternatively, used. In general, appropriate microchamber dimension(s) and/or cross-sectional shape(s) depend on the expected viscosity and/or a pump rate for the formation fluid 305. For example, larger microchambers 415 may be applicable for relatively viscous formation fluids to help decrease and/or reduce the energy and/or force needed to move the formation fluid 305 through the main channel 410, and smaller microchambers 415 may be selected to increase reaction times. In some examples, the cross-sectional dimension(s) of the main channel 410 are similar to the cross-sectional dimension(s) of the microchambers 415. When multiple microchambers 415 are implemented, the microchambers 415 may have different shapes and/or dimensions. The shape(s) and/or dimension(s) of particular microchambers 415 may be selected based on the particular chemical and/or fluidic properties of the formation fluid 305 and/or the reagent 310. For example, a first microchamber 415 may have a first shape and dimension(s) suitable for detecting a first reaction product using a first type of reagent 310, while a second microchamber 415 has a second shape and dimension(s) suitable for detecting a second reaction product using a second type of reagent 310. In such examples, different types of detectors 365 and/or excitation sources 360 may be associated with different microchambers 415. Thus, while a single reagent 310, a single excitation source 360 and a single detector 365 are shown in FIG. 4, the example chemical detection assembly 400 of FIG. 4 could include multiple types of reagents 310, multiple excitation sources 360 and/or multiple detectors 365. As such, the example chemical detection assembly 400 of FIG. 4 can be used to detect the presence of different types of chemicals.

The example microfluidic chamber 405 of FIG. 4 is operated by a) closing the valve 320 and/or stopping the pump 321, and b) opening the valve 330 and/or starting the pump 331 so that only example reagent 310 flows through the microfluidic chamber 405 in order to fill the microchambers 415 with the reagent 310. As the reagent 310 flows through the main channel 410 a portion of the reagent 310 is trapped in the microchambers 415. The valve 330is then closed and/or the pump 331 stopped, and the valve 320 opened and/or the pump 321 started to allow the formation fluid 305 to flow through the main channel 410. As the formation fluid 305 flows through the main channel 410 the formation fluid 305 reacts with the reagent 310 trapped in the microchambers 415 leaving a corresponding reaction product in the microchambers 415. One or more properties of the trapped reaction products can be measured, as described above in connection with FIG. 3, using the excitation source 360 and the detectors 365 for respective ones of the microchambers 415. Once the property(-ies) of the reaction products have been measured, the above process can be repeated to flush the main channel 410 and the microchambers 415 and test additional formation fluid(s) 305. As described above, the type of the reagent 310, the excitation source 360 and the detector(s) 365 used depends on which chemical(s) are being detected.

Because the locations of the example microchambers 415 of FIG. 4 are physically fixed relative to the moving reaction products 370 of FIG. 3, the example detectors 365 of FIG. 4 can be carefully and/or precisely aligned with the microchambers 415, thereby increasing the sensitivity and/or efficiency of the detectors 365. In some examples, the walls of the microchambers 415 are formed to be hydrophilic while the walls of the main channel 410 are formed to be hydrophobic. However, the walls of the microchambers 415 and the main channel 410 can all be formed to be hydrophilic.

To control the chemical detection assembly 400, the example chemical detection assembly 300 of FIG. 3 includes a chemical detection controller 420. The example chemical detection controller 420 of FIG. 3(*a*) controls the valves 320 and 330 and/or the pumps 321 and 331 to flush and trap the reagent 310 in the microchambers 415, (*b*) controls the valves 320 and 330 and/or the pumps 321 and 331 to flow formation fluid through the main channel 410 to form reaction products in the microchambers 415, and (*c*) controls the excitation source 360 and the detectors 365 to measure one or more properties of the trapped reaction products. The example controller 420 stores the measured properties in any type and/or number of memory(-ies) and/or memory device(s), one of which is designated at reference numeral 425, for later retrieval. Additionally or alternatively, the measured properties can be sent to a surface computer (not shown) using telemetry, and/or be analyzed by the example chemical detection controller 420 to determine whether a chemical is present in the formation fluid 305. The example chemical detection controller 420 may be implemented by hardware, software, firmware and/or any combination of hardware, software and/or firmware. Thus, for example, the example chemical detection controller 420 may be implemented by one or more circuit(s), programmable processor(s), ASIC(s), PLD(s) and/or FPLD(s), etc.

To record operation information and/or data, the example chemical detection assembly 400 of FIG. 4 includes any number and/or type(s) of recorders, one of which is designated at reference numeral 430. The example recorder 430 of FIG. 4 records, for example, operation time durations, number of valve activations, and/or temperature. Such information may be used, for example, for maintenance purposes, and/or to perform failure and reliability analyses. Information, data, parameters and/or any other values recorded by the example recorder 430 may be, for example, stored in the example memory and/or memory device 425.

While an example manner of implementing the example chemical detection assembly 26 of FIGS. 1 and 2 has been illustrated in FIG. 4, one or more of the example interfaces, channels 410, chambers 405, 415, containers, valves 320 and 330, pumps 321 and 331, detectors 365, excitation sources 360, flowlines 46, elements and/or devices illustrated in FIG. 4 may be combined, divided, re-arranged, omitted, eliminated and/or implemented in any other way. For example, the pumps 321 and 331 may be omitted. Further, a chemical detection assembly may include interfaces, channels 410, chambers 405 and 415, containers, valves 320 and 330, pumps 321 and 331, detectors 365, excitation sources 360, flowlines 46, elements and/or devices instead oft or in addition to, those illustrated in FIG. 4 and/or may include more than one of any or all of the illustrated interfaces, data structures, elements, processes and/or devices. For example, the valve 330 and the pump 321 of FIG. 4 could be removed and a heater (not shown) used to a control a flow of the reagent 310 into the microfluidic chamber 410, in a similar manner to that described above in connection with FIG. 3. Additionally or alternatively, the same or a different heater may be used to evaporate formation fluid 305, reagent 310 and/or reaction products from within the microfluidic chamber 405 and/or microchambers 415. In some examples, a heater is associated with each of the microchambers 415 to evaporate fluids trapped within the microchambers 415.

While not shown in FIG. 4 for ease of illustration, the example chemical detection assembly 400 of FIG. 4 may include one or more additional containers and/or reservoirs to store one or more additional chemicals and/or liquids. Such additional chemicals and/or liquids may be used to, for example, flush and/or rinse the microfluidic chamber 405 and/or the microchambers 415 and/or to clean the detectors 365 before the reagent 310 is introduced into the channel 405 and is subsequently trapped in the microchambers 415. For example, the microfluidic chamber 405 and/or the microchambers 415 could be flushed and/or rinsed with ethanol, acetone, etc. If the reagent 310 would react with a chemical and/or liquid used the rinse and/or flush the microfluidic chamber 405 and/or the microchambers 415, the microfluidic chamber 405 and/or the microchambers 415 could be subsequently rinsed and/or flushed with water prior to introduction of the reagent 310. Additionally or alternatively, the example chemical detection assembly 400 of FIG. 4 could include a heater to reduce the viscosity of the formation fluid 305 and/or the reagent 310 to reduce the amount of energy required to pump them through the microfluidic chamber 405.

Figure 5:
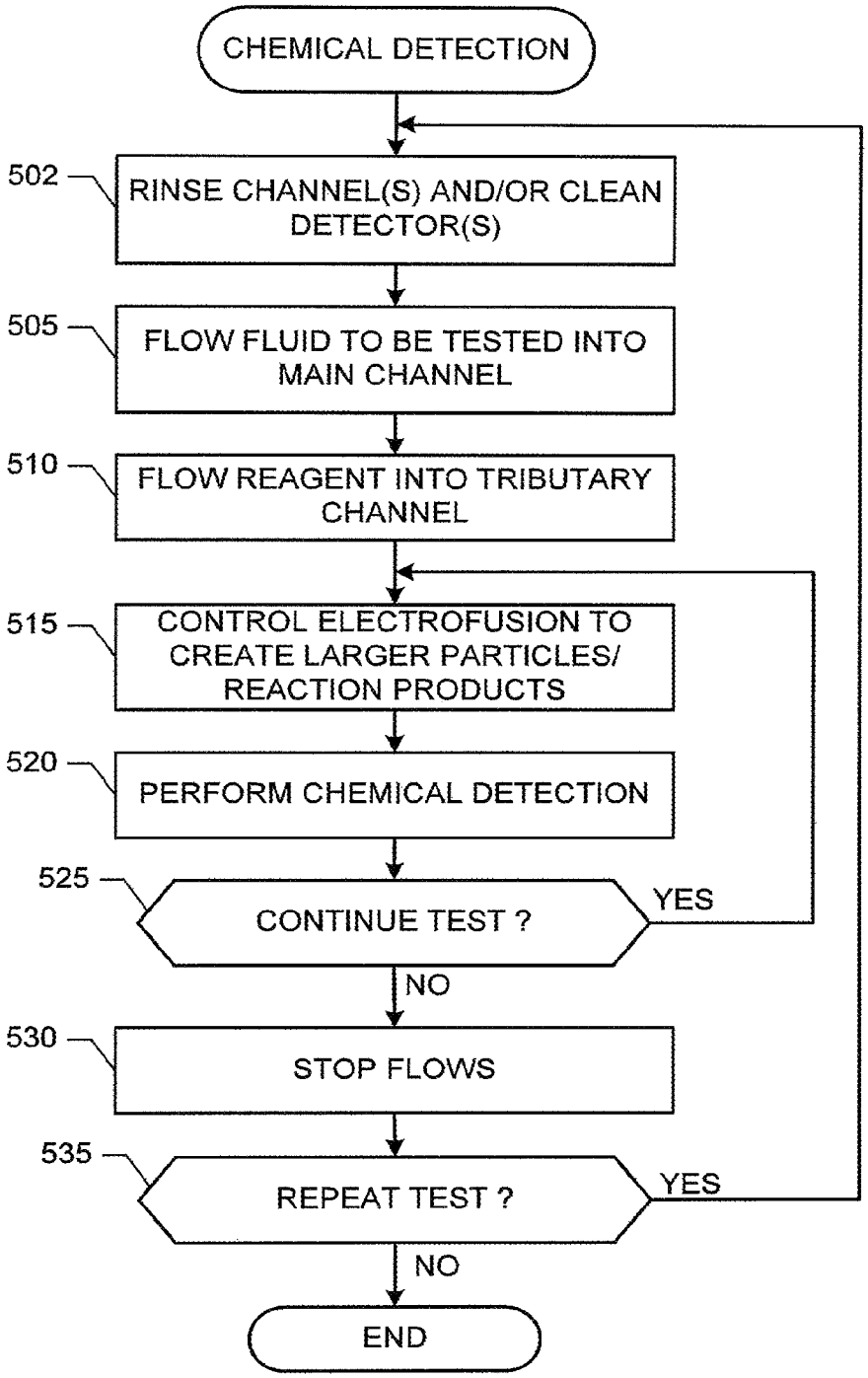
FIGS. 5 and 6 illustrate example processes that may be carried out to perform in situ chemical detection, and/or to implement any or all of the example chemical detection assemblies of FIGS. 1-4.
Figure 6:
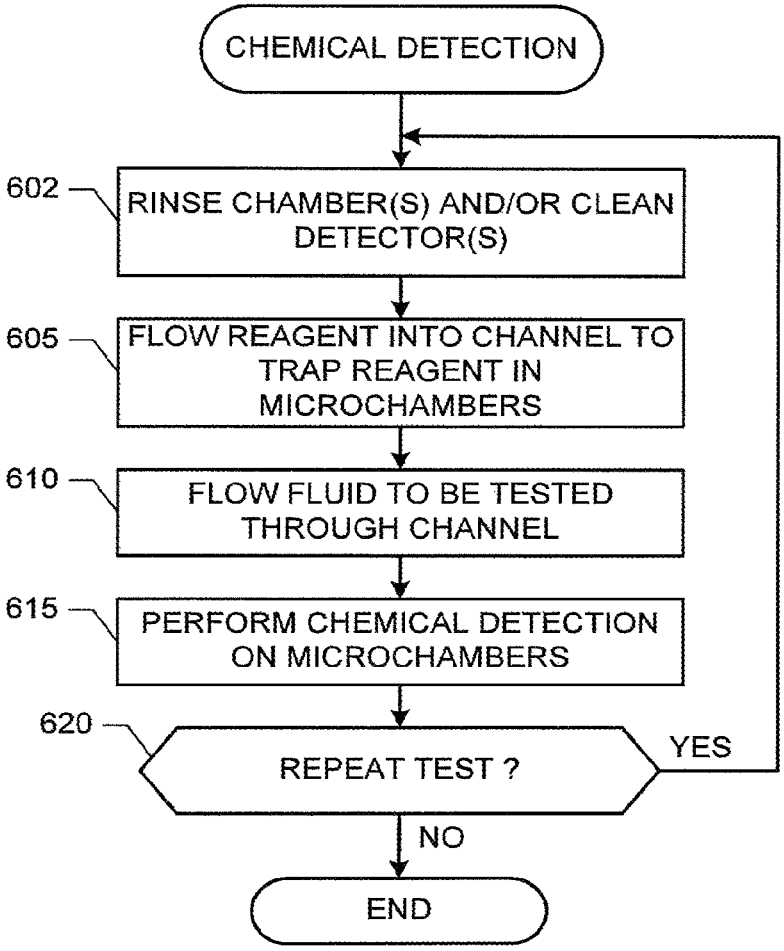

FIGS. 5 and 6 illustrate example processes that may be carried out to implement the example chemical detection controllers 380 and 420, respectively, and/or, more generally to implement the example chemical detections assemblies 26, 300 and 400 of FIGS. 1-4. The example processes of FIGS. 5 and 6 may be carried out by a processor, a controller and/or any other suitable processing device. For example, the example processes of FIGS. 5 and 6 may be embodied in coded instructions stored on any tangible computer-readable medium such as a flash memory, a compact disc (CD), a digital versatile disc (DVD), a floppy disk, a read-only memory (ROM), a random-access memory (RAM), a programmable ROM (PROM), an electronically-programmable ROM (EPROM), and/or an electronically-erasable PROM (EEPROM), an optical storage disk, an optical storage device, magnetic storage disk, a magnetic storage device, and/or any other medium which can be used to carry or store program code and/or instructions in the form of machine-accessible and/or machine-readable instructions or data structures, and which can be accessed by a processor, a general-purpose or special-purpose computer, or other machine with a processor (e.g., the example processor platform P100 discussed below in connection with FIG. 7). Combinations of the above are also included within the scope of computer-readable media. Machine-readable instructions comprise, for example, instructions and/or data that cause a processor, a general-purpose computer, special-purpose computer, or a special-purpose processing machine to implement one or more particular processes. Alternatively, some or all of the example processes of FIGS. 5 and 6 may be implemented using any combination(s) of ASIC(s), PLD(s), FPLD(s), discrete logic, hardware, firmware, etc. Also, some or all of the example processes of FIGS. 5 and 6 may instead be implemented manually or as any combination of any of the foregoing techniques, for example, any combination of firmware, software, discrete logic and/or hardware. Further, many other methods of implementing the example operations of FIGS. 5 and 6 may be employed. For example, the order of execution of the blocks may be changed, and/or one or more of the blocks described may be changed, eliminated, sub-divided, or combined. Additionally, any or all of the example processes of FIGS. 5 and 6 may be carried out sequentially and/or carried out in parallel by, for example, separate processing threads, processors, devices, discrete logic, circuits, etc.

The example process of FIG. 5 begins with the example chemical detection controller 380 of FIG. 3 flushing and/or rinsing the channel 335 and/or the channel 340 and/or cleaning the detector 365 using one or more chemicals and/or liquids, as described above in connection with FIG. 3 (block 502). The chemical detector controller 380 adjusts the example valve 320 and/or the pump 321 to allow the formation fluid 305 to flow through the main channel 335 (block 505). The controller 380 adjusts the valve 330 and/or the pump 331 to allow the reagent 310 to flow through the tributary channel 340 such that microfluidic-scale droplets of the reagent 310 are dispersed within the formation fluid 305 (block 510). In some examples, the controller 380 controls the electrofusion device 375 to fuse, join and/or bond together the reaction products 355 into larger reaction products 370 (block 515). The controller 380 performs a chemical detection process by controlling the excitation source 360 to excite the reaction products 355, 370, receiving one or more property measurements of the excited reaction products 355, 370 from the detector 365, and storing the results in the memory 385 (block 520). If chemical detection testing is to continue (block 525), control returns to block 515. If chemical detection testing is completed (block 525), the controller 380 shuts the valve 330 and/or stops the pump 331 to conserve unused reagent 310 and, in some examples, shuts the valve 320 and/or stops the pump 321 (block 530). If testing is to be repeated (e.g., for a different formation fluid 305 and/or using a different type of reagent 310) (block 535), control returns to block 502 to flush the channels 335 and/or 340, and/or to clean the detector(s) 365. If testing is not to be repeated (block 535), control exits from the example process of FIG. 5.

The example process of FIG. 6 begins with the example chemical detection controller 420 of FIG. 4 flushing and/or rinsing the chambers 410 and/or 415 and/or cleaning the detector(s) 365 using one or more chemicals and/or liquids, as described above in connection with FIG. 4 (block 602). The chemical detector controller 420 opens the valve 330 and/or starting the pump 331 to allow the reagent 310 to flow through the main channel 410 and become trapped in the microchambers 415 (block 605). The controller 410*a*) closes the valve 330 and/or stops the pump 331, and *b*) opens the valve 320 and/or starts the pump 321 to allow the formation fluid 305 to flow through the main channel 410 and react with the trapped reagent 310 to form reaction products within the microchambers 415 (block 610). The controller 420 then controls the excitation source 360 to excite the reaction products 355, 370, receives one or more property measurements of the excited reaction products 355, 370 from the detector 365, and stores the results in the memory 385 (block 615). If testing is to be repeated (e.g., for a different formation fluid 305 and/or using a different type of reagent 310) (block 620), control returns to block 602 to flush the microchambers 415 and/or clean the detector(s) 365, and trap unreacted reagent 310 within the microchambers 415. If testing is not to be repeated (block 620), control exits from the example process of FIG. 6.

Figure 7:
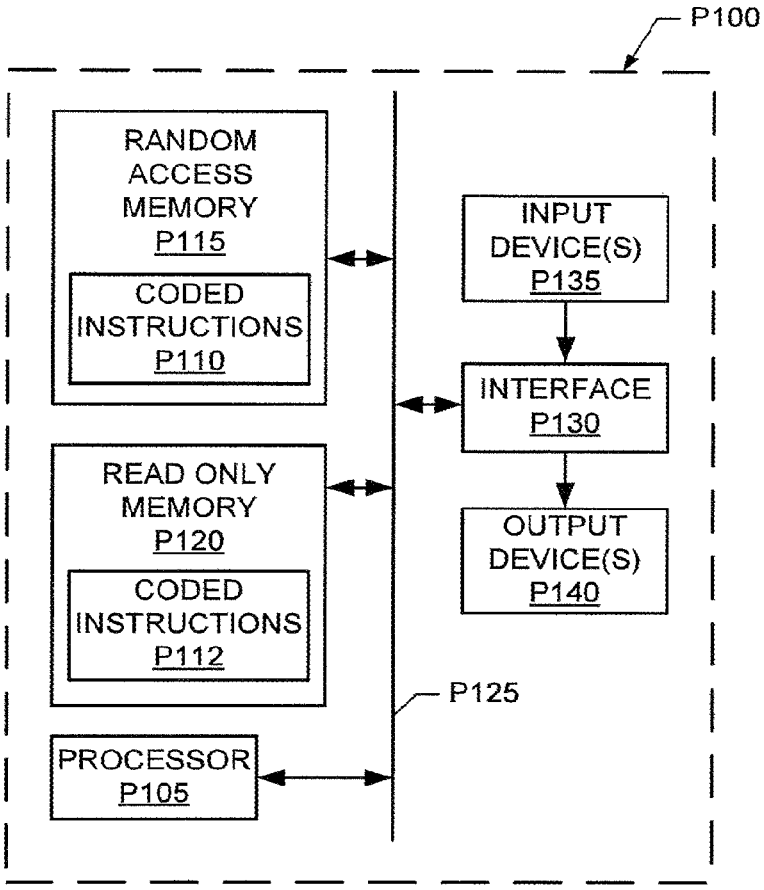
FIG. 7 is a schematic illustration of an example processor platform that may be used and/or programmed to carry out the example processes of FIGS. 5 and/or 6, and/or to implement any of all of the methods and apparatus disclosed herein.

FIG. 7 is a schematic diagram of an example processor platform P100 that may be used and/or programmed to implement the example controllers 380 and 420 and/or the example chemical detection assemblies 26, 300 and 400 disclosed herein. For example, the processor platform P100 can be implemented by one or more general-purpose processors, processor cores, microcontrollers, etc.

The processor platform P100 of the example of FIG. 7 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes of FIGS. 5 and 6 to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to implement the example memories 385 and 425.

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, control the example valves 320 and 330, the example pumps 321 and 331, the example electrofusion device 375, and/or the example excitation source 360. The example input device P135 may be used to, for example, collect data from the example detectors 365.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A method to perform detection of a chemical within a wellbore, the method comprising:

flowing a reagent through a channel via an opened first valve to a microchamber associated with the channel;

trapping by closing the first valve a portion of the reagent in the microchamber;

flowing a formation fluid from a geologic formation via an opened second valve through the microchamber in the channel;

trapping by closing the second valve a portion of formation fluid to form a reaction product of the trapped portions of the reagent and the formation fluid within the microchamber;

and measuring a property of the reaction product, the property representative of a presence of the chemical in the formation fluid.

2. A method as defined in claim 1, further comprising exciting the reaction product, wherein measuring the property comprises measuring an energy emitted by the reaction product in response to the excitation.

3. A method as defined in claim 1, wherein measuring the property comprises measuring a fluorescence of the reaction product.

4. A method as defined in claim 1, wherein the chemical comprises at least one of hydrogen sulfide or carbon dioxide, and the reagent comprises at least one of fluoresce in mercuric acetate, limewater or phenol red.

5. A method as defined in claim 1, wherein the microchamber has a feature size of 100 microns.

6. A method as defined in claim 1, further comprising at least one of a valve or a heater to regulate a flow of the reagent into the channel.

7. A method as defined in claim 1, further comprising applying heat to evaporate at least one of the formation fluid, the reagent or the reaction product.

* * * * *